United States Patent [19]

Sayer

[11] 3,944,866

[45] Mar. 16, 1976

[54] THERMIONIC EMITTER OF LANTHANUM STRONTIUM VANADATES

[75] Inventor: Michael Sayer, Kingston, Canada

[73] Assignee: Canadian Patents & Development Ltd., Ottawa, Canada

[22] Filed: Apr. 8, 1974

[21] Appl. No.: 458,849

[52] U.S. Cl. ..... 313/346 R; 313/337; 252/518; 252/521

[51] Int. Cl.[2] ... H01J 1/14; H01J 19/06; H01B 1/06

[58] Field of Search..... 252/521, 518; 313/346 R, 313/337, 336

[56] References Cited

UNITED STATES PATENTS

| | | | |
|---|---|---|---|
| 2,639,399 | 5/1953 | Lafferty | 313/345 |
| 3,312,856 | 4/1967 | Lafferty et al. | 313/346 R |
| 3,440,475 | 4/1969 | Schiller et al. | 313/346 R |
| 3,630,770 | 12/1971 | Favreau | 313/346 R |

*Primary Examiner*—Benjamin R. Padgett
*Assistant Examiner*—Josephine Lloyd
*Attorney, Agent, or Firm*—James R. Hughes

[57] ABSTRACT

A thermionic emitter for apparatus such as electron microscopes, scanning electron microscopes, and high power vacuum tubes which require a source of electrons formed from lanthanum strontium vanadate which is prepared from the compounds $La_{(1-x)}$ $Sr_{(x)}$ $VO_3$, where $x$ is the fraction of strontium (Sr) incorporated into $LaVO_3$. The value of $x$ lies between 0.1 and 0.4.

1 Claim, 2 Drawing Figures

THERMIONIC EMITTER OF LANTHANUM STRONTIUM VANADATES

This invention relates to thermionics emitters for apparatus such as electron microscopes, scanning electron microscopes, and high power vacuum tubes which require a source of electrons.

At the present time thermionic emitters take the form of either indirectly heated nickel cathodes coated with various oxides of alkaline earth metals or directly heated cathodes of components such as lanthanum boride ($LaB_6$). Lanthanum hexaboride emitters are described in U.S. Pat. No. 2,639,399 to J. M. Lafferty and in U.S. Pat. No. 3,312,856 to J. M. Lafferty et al.

Indirectly heated oxide coated cathodes are very sensitive to exposure to air making them unsuitable for apparatus in which the electron source is demountable. Compounds such as lanthanum boride work reasonably well, but problems of making contacts to the material are experienced, corrosion occurs at the contacts during extended periods of operation, and some deterioration of performance occurs over long periods of time.

It is an object of the invention to provide an improved directly or indirectly heated thermionic cathode for producing a beam of electrons which has a low resistivity and which has a resistance that increases with temperature.

It is another object of the invention to provide a directly or indirectly heated cathode that can operate in the temperature range 1200°–1500°C with good stability for extended periods of time.

It is another object of the invention to provide a material for a thermionic emitter that will make good contact with metal conductors.

These and other objects of the invention are achieved by a thermionic emitter formed from lanthanum strontium vanadate which is prepared from the compounds $La_{(1-x)}\ Sr_{(x)}\ VO_3$, where $x$ is the fraction of strontium (Sr) incorporated into $LaVO_3$. The value of $x$ lies between 0.1 and 0.4.

In drawings which illustrate embodiments of the invention,

Figure 1:
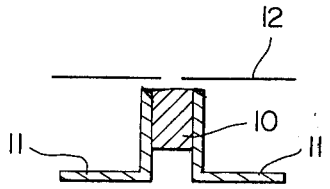
FIG. 1 is a cross section of a simple mounting arrangement of a cathode.

Referring to FIG. 1 a thermionic emitter is formed of a block of material 10 held between conducting metal plates 11 by spring-loaded contact. The conducting metal may be tantalum, tungsten, or molybdenum in that these metals make good contact with material 10 and the contacts are generally free from corrosion. The emitter is directly heated by passing an electric current through it. Copious electrons are formed and these pass through an aperture in plate 12 into the apparatus requiring an electron beam source. The block of material 10 is formed from lanthanum strontium vanadate of the formula: $La_{(1-x)}\ Sr_x\ VO_3$ where $x$ is the fraction of strontium incorporated in $La\ VO_3$. It has been found that for optimum operation $0.1 < x < 0.4$. Typical dimensions are 1 mm. × 2 mm. × 4 mm. for the block and 0.025 cm thick for the contacting metal.

Figure 2:
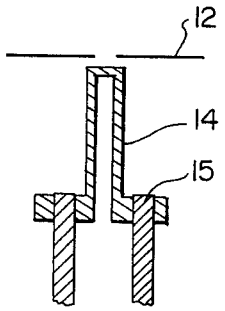
FIG. 2 is a cross-section of an alternative structure.

FIG. 2 shows a typical hair-pin shaped emitter 14 of lantanum strontium vanadate with molybdenum sheet contacts 15.

An example of a method of preparation of the lanthanum strontium vanadate compound is as follows: The required quantities of Lanthanum oxylate $La_2(C_2O_4)\ 9H_2O$ and strontium oxylate $SrC_2O_4\ H_2O$ and vanadium pentoxide ($V_2O_5$) are mixed in a ball mill and fired under an atmosphere of 15% hydrogen 85% argon at 600°C. The firing period is normally 1 hour and suffices to remove water, $CO_2$ and oxygen from the compounds. The fired materials is ball milled and then fired at about 1300°C for 12 hours in an atmosphere of 85% argon 15% hydrogen. After a further ball milling the fired material is pelletised under high pressure and the pellets are fired to a temperature in the range 1700° to 2100°C for times of 10 mins to 1 hour. This can conveniently be done in an atmosphere of 15% hydrogen 85% argon either in a vacuum using electron beam heating or by firing in a molybdenum or tungsten crucible heated by a high frequency induction furnace.

It has been found that the incorporation of strontium in the emitting material reduces the resistivity markedly and causes the material to behave like a metal, having a resistance which increases with temperature. The presence of strontium also results in a low thermionic work function (e.g. about 2.4 eV for $La_{0.7}Sr_{0.3}VO_3$) which allows the cathodes to operate at low temperature. These characteristics allow direct electrical heating of small slabs of material with Ta, W or Mo electrodes pressed against opposite sides of the slabs. Preliminary experiments indicate little corrosion at the contacts or deterioration with time, and the possibility of stable thermionic emitters operating in the temperature range 1200°–1500°C. The cathodes can be exposed to air when cold with no deterioration of subsequent performance.

I claim:

1. A thermionic emitter for electron beam apparatus comprising a metallic, electrically conducting support structure and a shaped piece of electron emitting material mounted on and in electrical contact with the said support structure, said material being the compound lanthanun strontium vanadate having the formula $La_{(1-x)}\ Sr_x\ VO_3$ where $x$ is the fraction of strontium (Sr) incorporated in the $La\ VO_3$ and with $x$ lying between 0.01 and 0.4.

* * * * *